US008146770B2

(12) United States Patent
Newman

(10) Patent No.: US 8,146,770 B2
(45) Date of Patent: Apr. 3, 2012

(54) ADJUSTABLE CLOSURE FOR A CONTAINER

(76) Inventor: Duncan Newman, Toronto (CA)

( * ) Notice: Subject to any disclaimer, the term of this patent is extended or adjusted under 35 U.S.C. 154(b) by 28 days.

(21) Appl. No.: 12/452,238

(22) PCT Filed: Jun. 19, 2008

(86) PCT No.: PCT/IB2008/003859
§ 371 (c)(1),
(2), (4) Date: Jun. 15, 2010

(87) PCT Pub. No.: WO2009/063331
PCT Pub. Date: May 22, 2009

(65) Prior Publication Data
US 2011/0017760 A1 Jan. 27, 2011

(51) Int. Cl.
*B65D 43/16* (2006.01)
*B65D 43/26* (2006.01)
*B65D 51/04* (2006.01)

(52) U.S. Cl. ..... 220/326; 220/318; 220/756; 220/817; 220/818

(58) Field of Classification Search ..... 220/326, 220/244, 318, 817, 818, 249, 813, 756
See application file for complete search history.

(56) References Cited

U.S. PATENT DOCUMENTS 2,574,338 A * 11/1951 Lewis ..... 222/473
2,574,876 A * 11/1951 Lebus ..... 222/473
2,616,584 A * 11/1952 Rausenberger et al. ..... 220/249
2,734,656 A * 2/1956 Schonfeld ..... 220/244
2,941,236 A * 6/1960 Monroe et al. ..... 16/368
3,186,577 A * 6/1965 Tennison ..... 220/244
3,770,160 A * 11/1973 Flider ..... 220/318
4,096,968 A * 6/1978 Treiber et al. ..... 220/314
4,132,327 A * 1/1979 Van Dyke et al. ..... 220/244
4,286,727 A * 9/1981 Limoncelli ..... 220/244
4,566,375 A * 1/1986 van der Schoot ..... 99/348
5,158,198 A * 10/1992 Melideo ..... 220/263
7,011,227 B2 * 3/2006 Ward et al. ..... 220/254.3

* cited by examiner

*Primary Examiner* — Mickey Yu
*Assistant Examiner* — Niki Eloshway
(74) *Attorney, Agent, or Firm* — Dowell & Dowell, P.C.

(57) ABSTRACT

An adjustable seal that is kinematically linked to a container to provide a complete seal of the container opening and to allow easy access to contents therein. The seal includes a lid portion and a sealing means, as well as a lever and a yoke, which are kinematically linked together via a plurality of pivot points. The seal also comprises a spring system having a springfront, a spring rear, and a spring, and the spring system is likewise mechanically connected to the other components. Due to this kinematic linkage, the closure is moveable among different positions to provide various degrees of access to and from the container via the container opening. As a result, the sealing system of the present invention protects against spillage and splash by completely sealing the container opening, as well as provides easy access to the contents of the container.

13 Claims, 18 Drawing Sheets

ADJUSTABLE CLOSURE FOR A CONTAINER

FIELD OF THE INVENTION

The invention is generally directed to a closure for a container. More specifically, the invention is directed to a closure system that is kinematically linked to a container so that the closure is moveable from a closed position to an open position.

BACKGROUND

Containers are often covered by some sort of closure or lid to prevent spillage of the contents therein. For example, beverage containers are typically fitted with lids to protect against splashing during transport of the beverage, as well as to mitigate spillage when the container is tipped. A conventional lid is usually screwed onto corresponding threads surrounding a container opening. While these lids are effective against spillage when a container is tipped, these lids also prevent immediate access to contents therein. In other words, a user must first unscrew the lid before being able to drink the beverage. Not only is having to unscrew a lid before each sip time consuming, it can also be dangerous for a user who is trying to enjoy a beverage while driving.

Consequently, lids that allow immediate access to a beverage while protecting against splash and spillage have become increasing popular. Such a lid is typically sized slightly larger than a container opening so that the lid seals the opening via a friction fit. The lid also includes a first opening for the beverage to flow through, as well a second, smaller vent opening to allow air to enter a container to prevent a vacuum from forming therein by replacing the space previously occupied by a beverage after the beverage flows out of the container.

While these lids do allow a user to easily access a beverage within a container, these lids suffer from significant drawbacks. For example, since each of these lids includes two openings, a container is never completely sealed. As a result, a beverage will spill out of the container if the container is tipped or jarred. Further, in light of the friction fit, this type of lid often does not provide a proper seal for the opening of a container, and consequently, the beverage leaks from the container when the container is tilted. Accordingly, there is a need for a lid or closure system that protects against spillage and splashing by forming a complete seal, as well as provides convenient access to the contents of a container.

SUMMARY

The present invention is directed to a closure that is kinematically linked to a container so as to provide a complete seal of the container opening and to allow easy access to contents therein. The closure system involves a lid portion and a sealing means, as well as a lever and a yoke, which are kinematically linked together via a plurality of pivot points. The closure also comprises a spring system including a springfront, a springrear, and a spring, and the spring system is likewise mechanically connected to the other components. Due to this kinematic linkage, the closure is moveable among different positions to provide various degrees of access to and from the container via the container opening. As a result, it is an object of the closure system of the present invention to protect against spillage and splash by completely sealing the container opening, as well as to provide easy access to the contents of the container.

It is second object of the invention to provide a closure system that is able to withstand pressure generated within a container and to maintain a complete seal of an opening of the container.

It is a third object of the invention to provide a closure system that maintains a constant interior volume of a container as an opening of the container is sealed or unsealed.

It is a fourth object of the invention to provide a closure that eliminates the need for second vent opening in a container by utilizing a lid portion that is tiltable about a center of pressure thereon.

BRIEF DESCRIPTION OF THE DRAWINGS

A better understanding of the invention will be had with reference to the attached drawings wherein.

DETAILED DESCRIPTION OF THE DRAWINGS

The present invention involves a closure system S that is kinematically linked to a container C. The container C may be any type of container having at least one opening O for providing access into the container C, such as cups, jars, cans, bottles, mugs, tanks, ports, and pipes. As shown in the Figs., the container C is preferably a beverage container for storing a beverage B. Further, the container C may also include a handle H, and the handle H is preferably a finger loop.

The closure S is preferably integrally formed with the container C to seal the opening O of the container C. Alternatively, the closure S may include an attaching means for securing the closure system S to the container C to seal the opening O. For example, the closure system S may include a threaded portion for screwing the closure S onto corresponding threads surrounding the container opening O.

Figure 1:
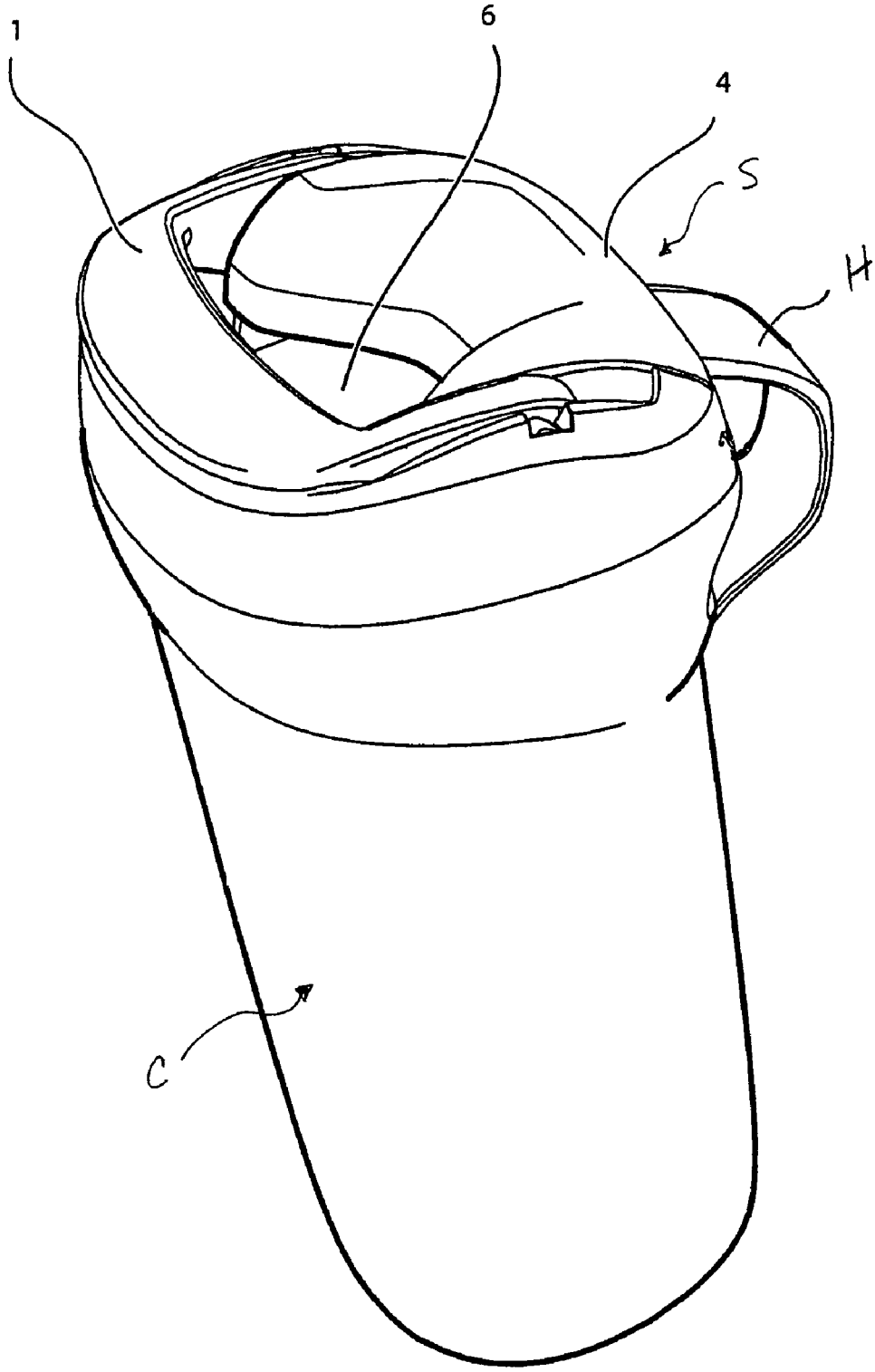
FIG. 1 is a perspective view of a container and adjustable closure Showing the seal in a closed, sealed position.
Figure 2:
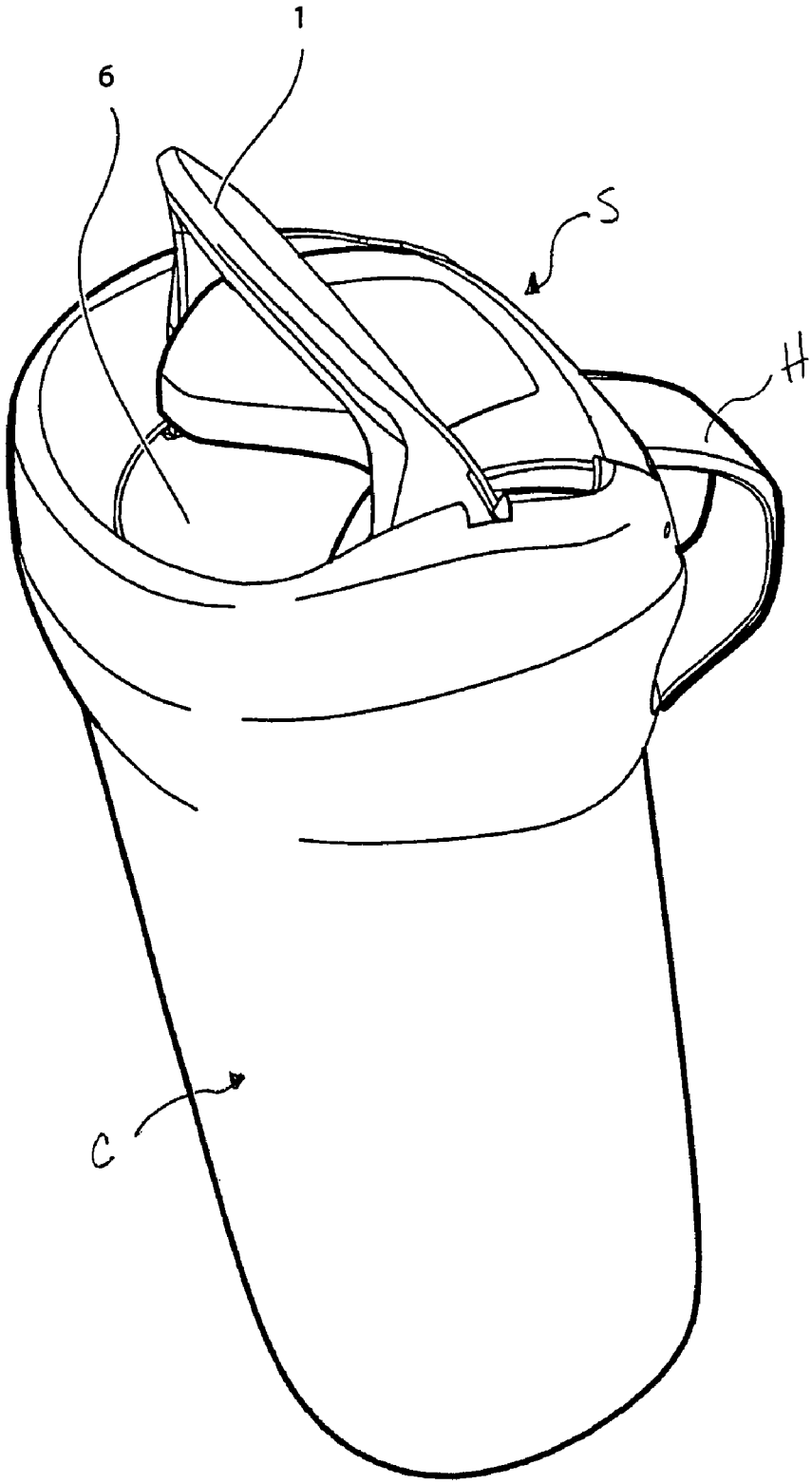
FIG. 2 shows the container and adjustable closure in a partly sealed, incipient break position.
Figure 3:
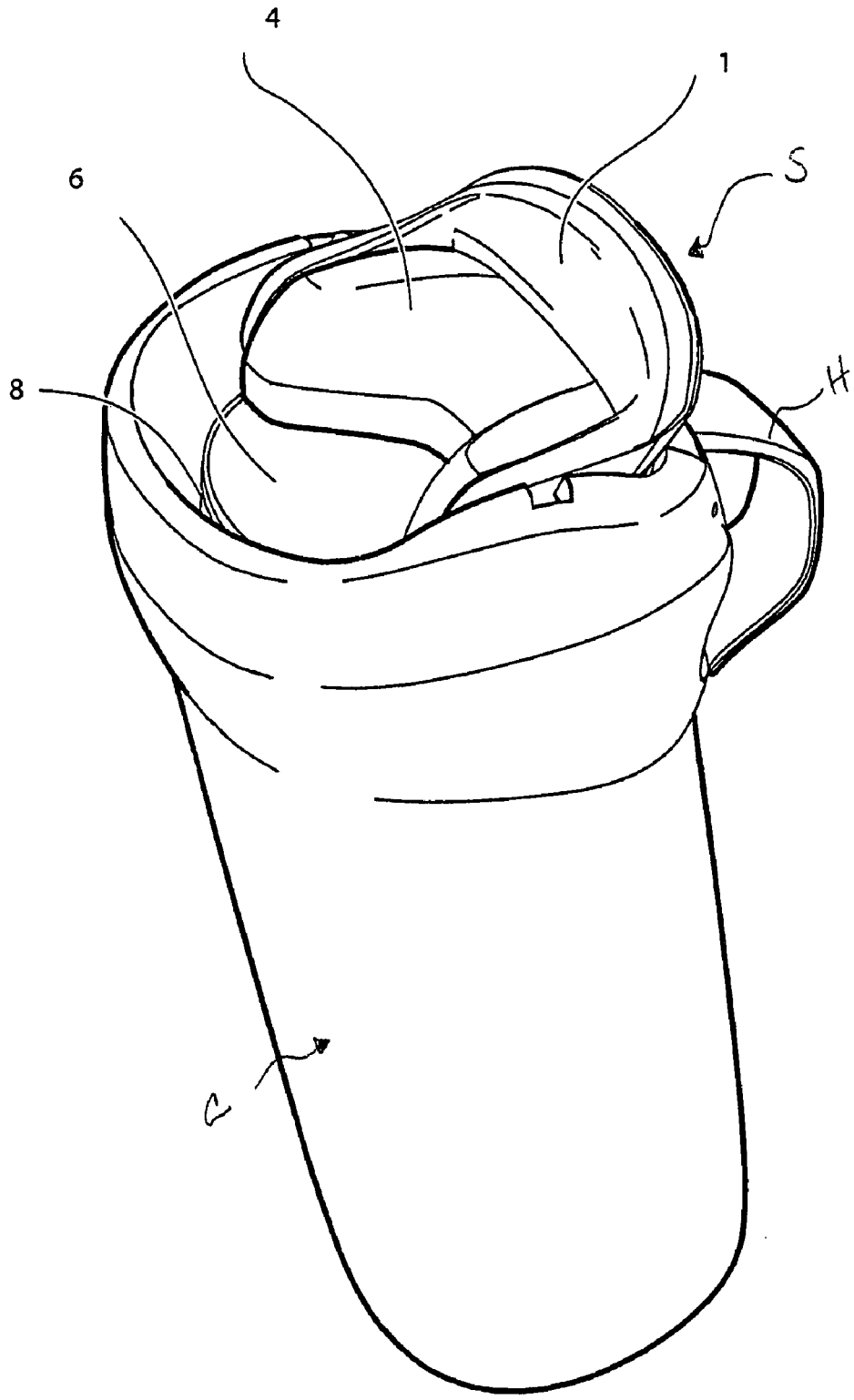
FIG. 3 shows the container and adjustable closure in an open position.
Figure 4:
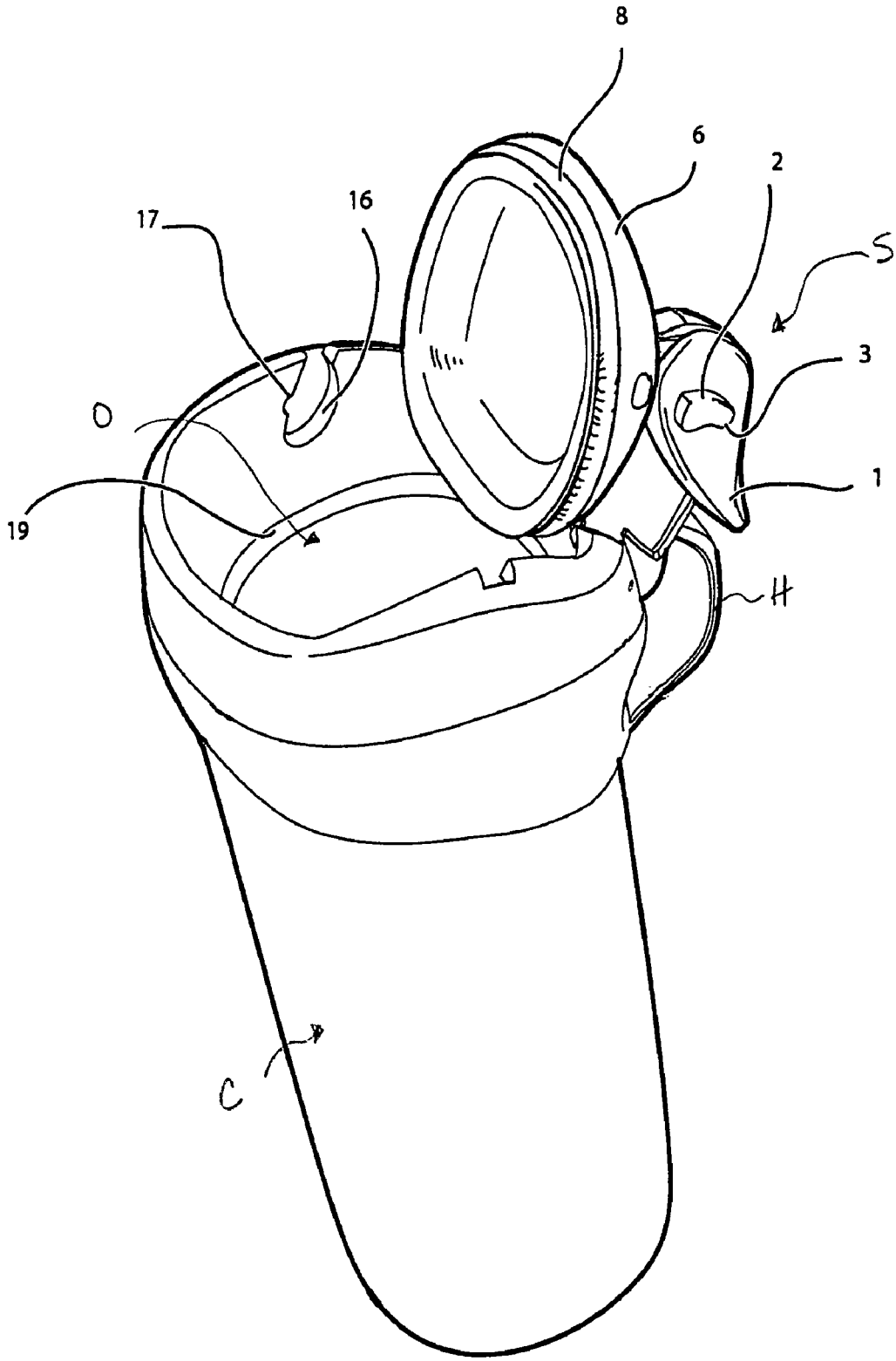
FIG. 4 shows the container and adjustable closure in a fully open position.
Figure 5:
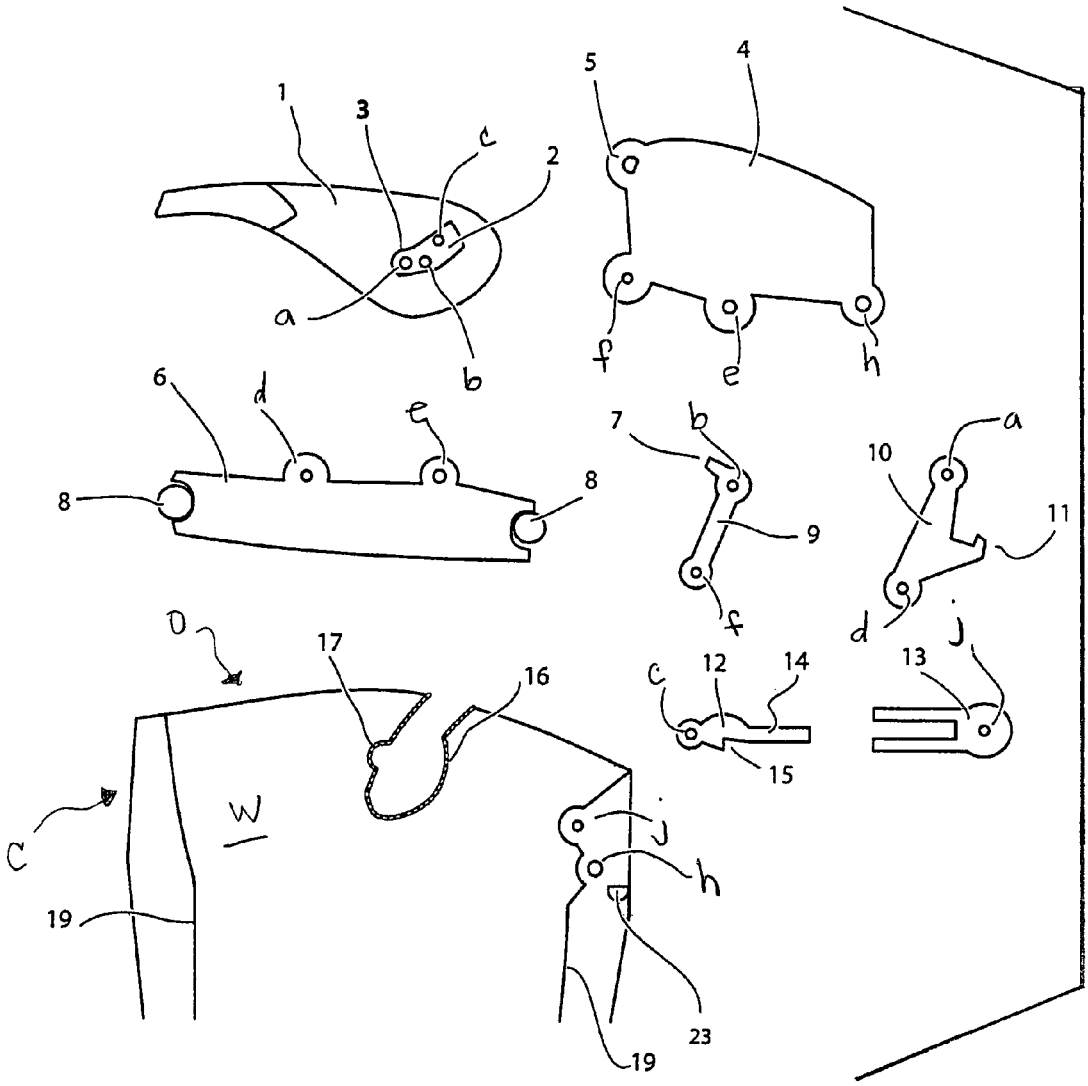
FIG. 5 is an exploded partial side view of a container and components of the adjustable closure of a first embodiment of the present invention in a disassembled position.
Figure 5A:
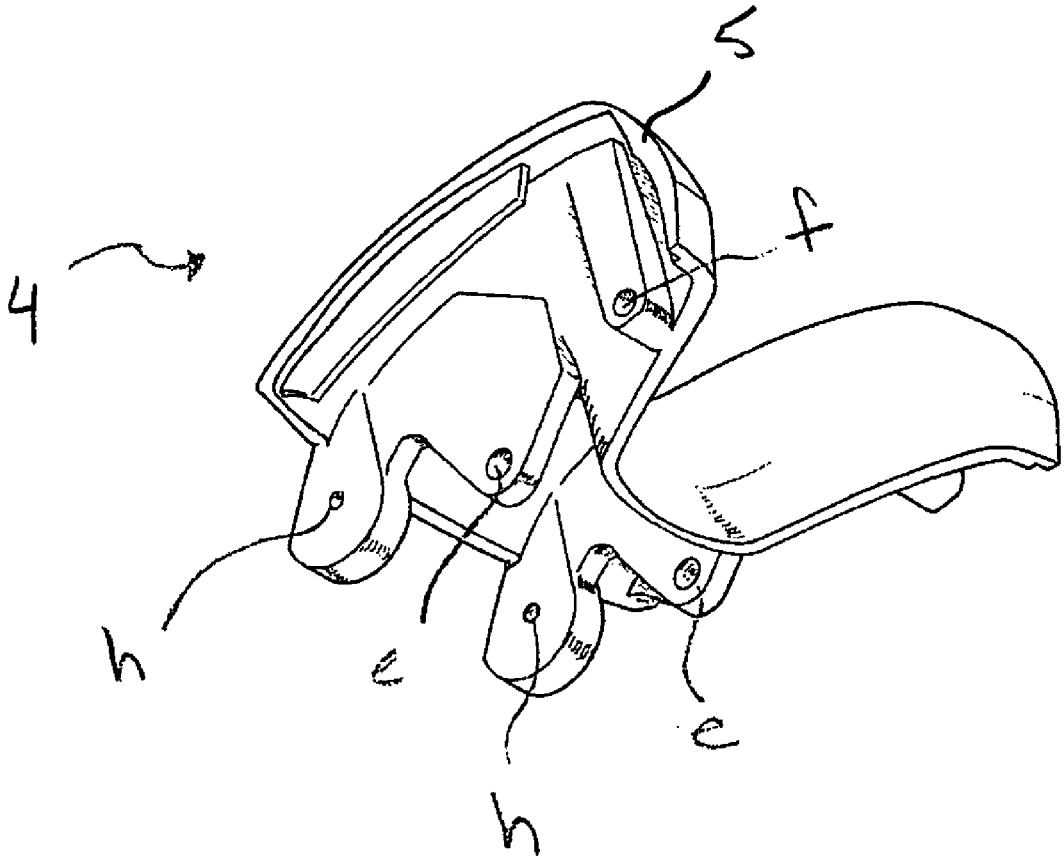
FIG. 5A is side perspective view of a yoke of the adjustable closure of the first embodiment.

Further, the closure system S is moveable among different positions to permit various degrees of access to and from the container C via the opening O. As shown in FIG. 1, the closure S is in a fully closed position to seal the opening O of the container C to prevent the beverage B from spilling or splashing out of the container C. In FIG. 2, the closure S is in an incipient break position wherein the opening O is partly unsealed. In FIG. 3, the closure S is in an open position to allow the beverage B to flow through the opening O of the container C, and in FIG. 4, the closure system S is in a fully open position to allow complete access of the container C via the opening O.

Sectioned side views of a first embodiment of the adjustable closure system S are shown in FIGS. 5-10. While the side views only illustrate half of the kinematic linkages of the closure system S, the closure S includes symmetrical linkages on the side not shown in the Figs. The closure S comprises a lever 1 having a locking means 2, and the locking means 2 includes an arcuate portion 3. The closure S also comprises a yoke 4 having a stop 5. In addition, the closure S includes a lid portion 6 and a resilient seal 8. The sealing 8 is preferably an elastomeric o-ring placed in a circumferential groove around the periphery of the lid portion 6.

The closure S also includes a link 9 having a link stop 7 and a leg 10 with a catch 11. The link stop 7 engages the stop 5 of the yoke 4 to limit the movement of the link 9. Further, the closure system S utilizes spring system including a springfront 12 and a springrear 13 that are secured to each other in a linear, sliding relationship along a spring 21, which urges the springfront 12 and the springrear 13 apart. The spring 21 is preferably a coil spring, but any suitable energy storing means may be used. The springfront 12 includes a latch 15 and an arm 14 for slidingly attaching the springfront 12 to the springrear 13.

The container C includes a pocket 16 with an arcuate portion 17. The container further includes a sealing surface 19 and a stop 23. If the closure S is integrally formed with the container C, then the pocket 16, the sealing surface 19, and the stop 23 are part of a container wall W. Alternatively, if the closure system S is removably secured to the container C, then the pocket 16 and the stop 23 are formed in a separate portion of the closure system S that is attached to the opening O.

To form a kinematic linkage between the closure system S and the container C, the lever 1 is pivotally connected to the leg 10, the link 9, and the springfront 12 at points a, b, and c, respectively, so that the connection of the lever 1 and the leg 10 at point a is not concentric with the arcuate portion 3 of the locking means 2 of the lever 1. The leg 10 is also pivotally connected to the lid portion 6 at a point d so that the leg 10 links the lever 1 with the lid portion 6. The lid portion 6 is also pivotally secured to the yoke 4 at a point e.

The yoke 4 is similarly pivotally connected to the link 9 at a point f. Consequently, the link 9 kinematically connects the yoke 4 with the lever 1. The yoke 4 is also pivotally secured to the container C at a point h, and the springrear 13 is likewise pivotally mounted to the container C at a point j. If the closure system S is integrally formed with the container C, the points h and j are located on a container wall W. Alternatively, if the closure S is fitted onto the container C, then points h and j are formed in a separate portion of the closure system S that is removably attached to the opening O.

In light of the linkages between the lever 1 and the yoke 4 via the link 9 and the yoke 4 and the container C at a pivot point h, the arcuate portion 3 of the locking means 2 of the lever 1 engages the arcuate portion 17 of the pocket 16 of the container C so that the arcuate portions 3 and 17 are concentric with each other. As a result, the locking means 2 cannot move within the pocket 16 other than by rotation of the lever 1 relative to the arcuate portions 3 and 17. In an alternative embodiment, the pocket 16 and the arcuate surface 17 are formed on the lever 1, and the locking means 2 and the arcuate surface 3 are formed on the container C.

The pivoting connections of kinematic linkages of the components of the closure system S and the container C may involve pins received in round aperatures. However, oblong slots may also be used to pivotally link the components so as to allow for translating movements, as well as pivoting movements. Further, the pins may not be sized to exactly fit the corresponding aperatures so as to provide some clearance between the pins and the aperatures, which also allows some translating movements between the components.

In light of the kinematic linkage between the closure S and the container C, the closure S is moveable among different positions to provide various degrees of access to and from the container C via the opening O. In other words, the closure system S can effectively seal the opening O of the container C, as well as provide convenient access to the beverage B within the container C and to the interior of the container C. Further, when the closure S is in the sealed position, the closure S is able to withstand an outward force caused by pressure generated by the beverage B within the container C.

Figure 6:
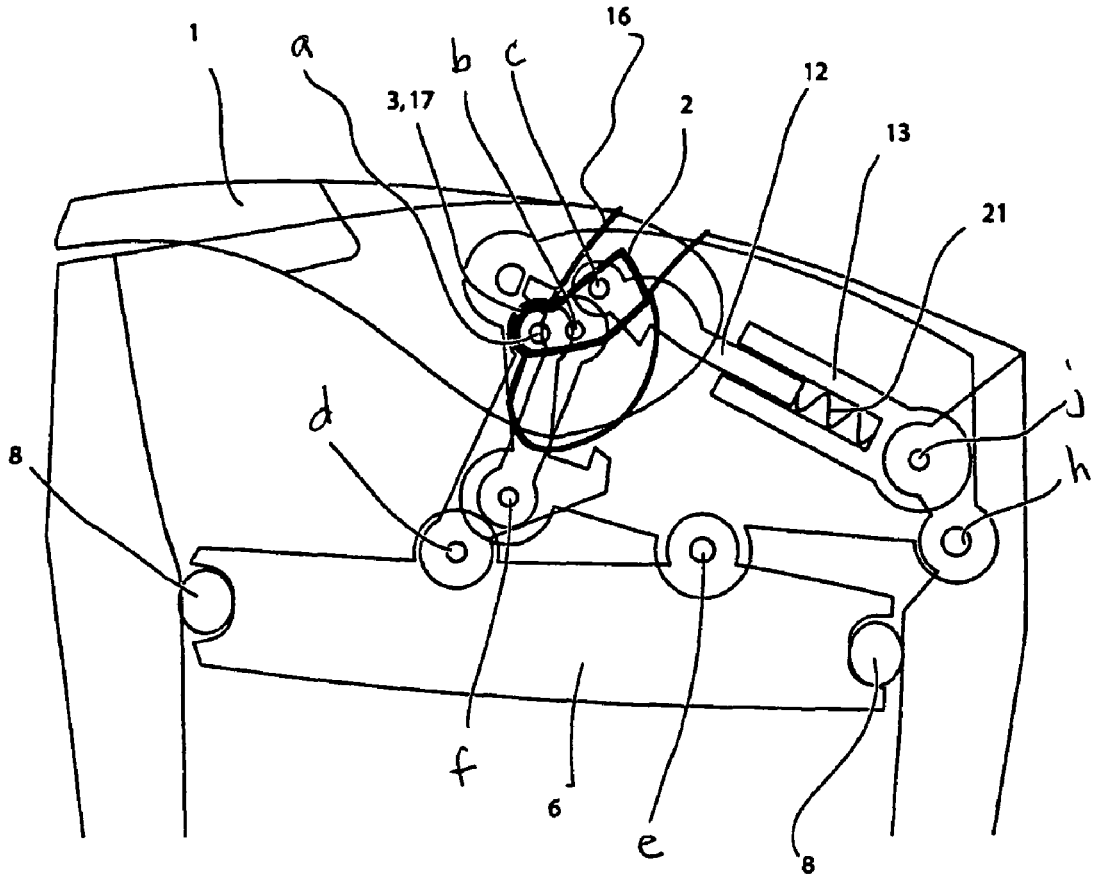
FIG. 6 is a sectioned partial side view of a container and the adjustable closure of the first embodiment, wherein the seal is in a closed, sealed position.

To completely seal the opening O of the container C and prevent a beverage from flowing out of the container C, the compression spring 21 forces the springfront 12 away from the springrear 13, which is connected to the container C at the point j. Due to the pivoting connection of the springfront 12 and the lever 1 at the point c, the spring force of the compression spring 21 likewise urges the lever 1 in a counterclockwise direction about the arcuate portions 3 and 17 of the lever 1 and the pocket 16 of the container C, respectively. Consequently, when the closure S is in the sealed position, the lever 1 is positioned furthest away from the point j where the springrear 13 is connected to the container C, as shown in FIG. 6.

When the lever 1 is positioned furthest away from the point j, the connection of the lever 1 to the lid portion 6 via the leg 10 causes the seal 8 to slide or roll against the sealing surface 19 until the seal 8 is compressed against the sealing surface 19. As a result of the compression of the seal 8 against the sealing surface 19, any gap between the lid portion 6 and the container wall W is closed, and the opening O of the container C is completely sealed.

Figure 7:
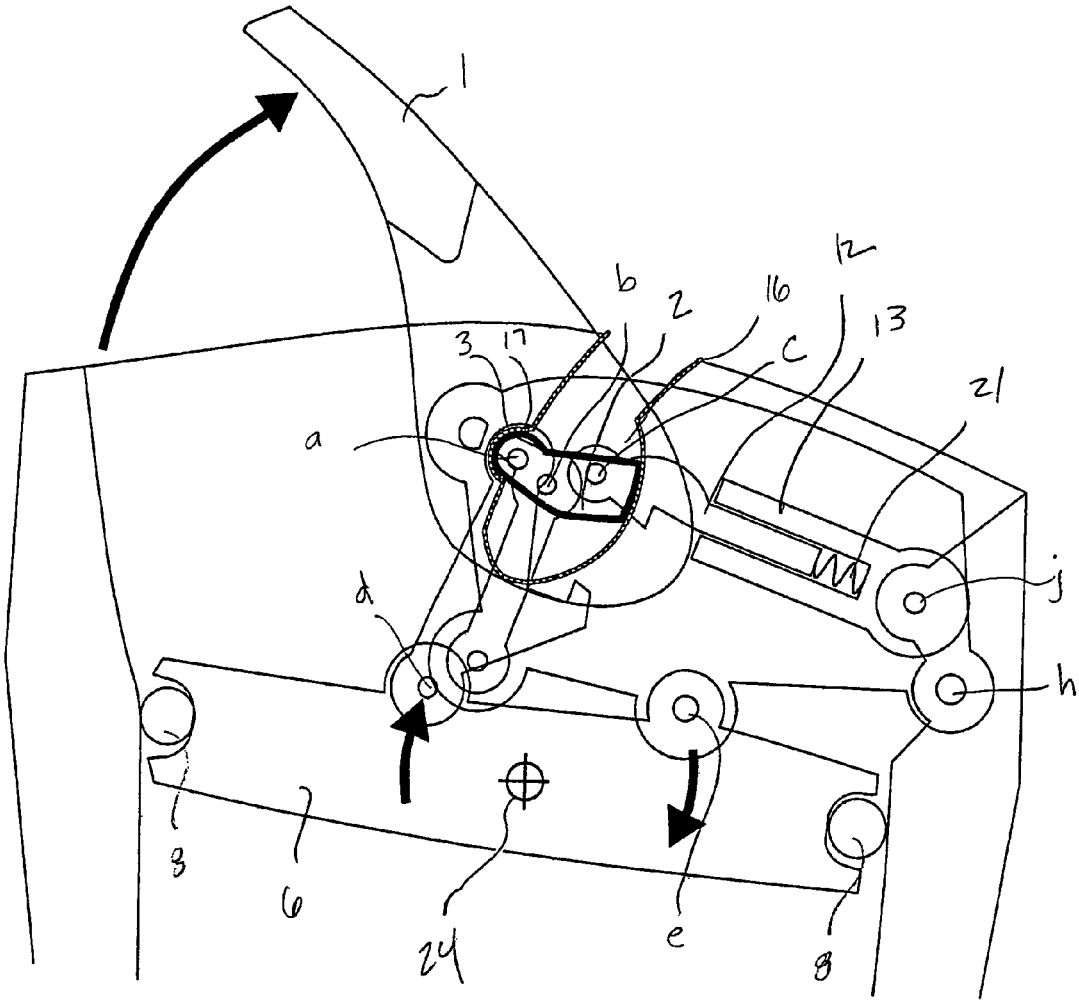
FIG. 7 shows the container and adjustable closure of FIG. 6 in a partly sealed, incipient break position.

To release the seal of the opening O, the lever 1 is rotated in a clockwise direction toward the point j. When the lever 1 reaches a position approximately 40° from the position shown in FIG. 6, the seal of the opening O is in an incipient break position. The kinematic linkage of the lever 1 and the lid portion 6 via the leg 10 causes a part of the lid portion 6 located at the point d where the leg 10 is connected to the lid portion 6 to start to move away from an interior of the container C. Simultaneously, the linkage of the lever 1 and the yoke 4 via the link 9 causes a part of the lid portion 6 located at the point e where the yoke 4 is connected to the lid portion 6 to start to move toward the interior of the container C, as shown in FIG. 7. As a result, the lid portion 6 rotates about a center of pressure 24 to decompress the seal 8, as well as maintain a substantially constant volume within the container C. In addition, in this position, the spring 21 is at a maximum compression, so there is essentially no torque on the lever 1.

Figure 8:
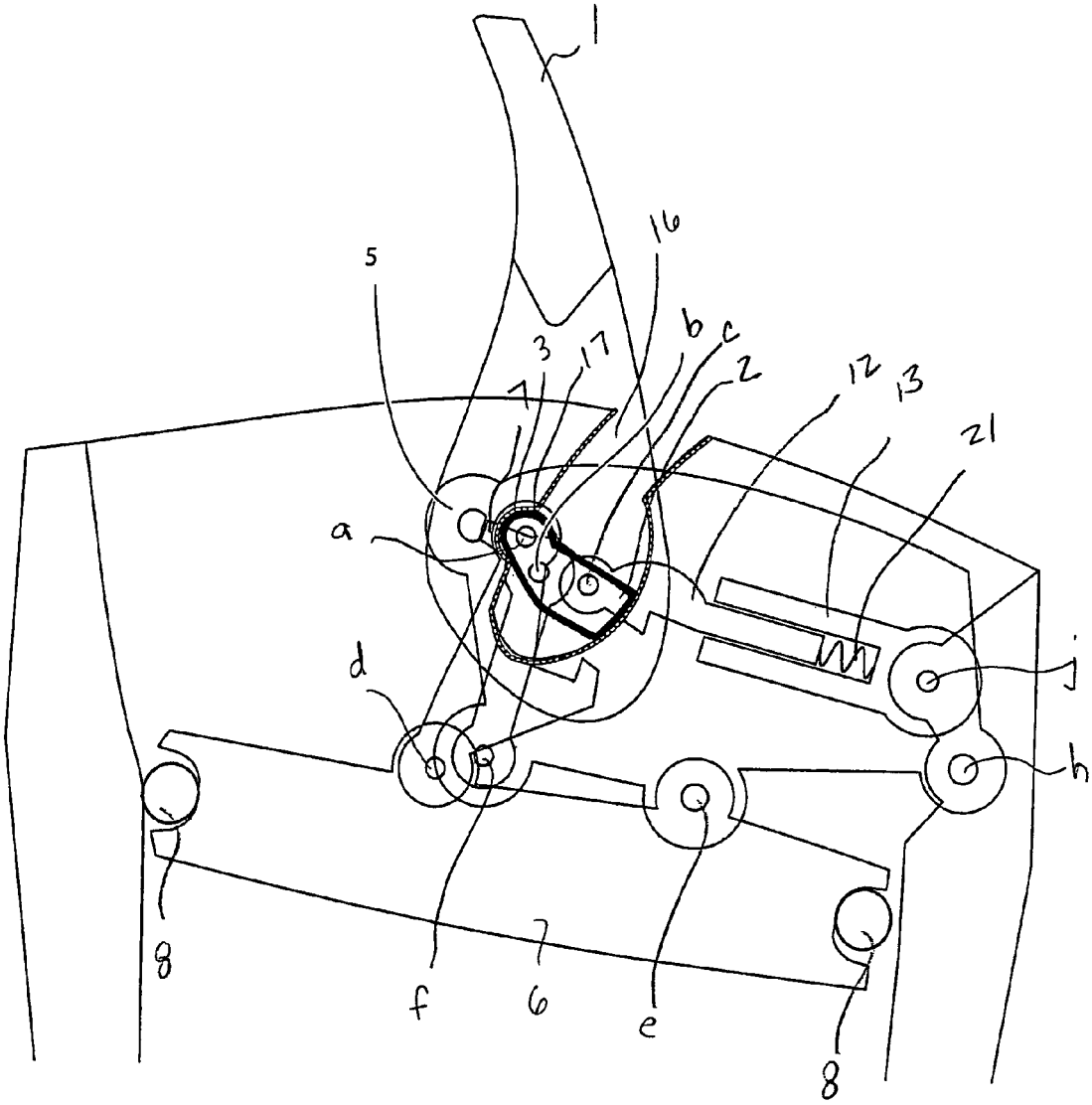
FIG. 8 shows the container and adjustable closure of FIGS. 6 and 7 in an unsealed position.

As the lever 1 is rotated further in a clockwise direction, the kinematic linkage of the components of the closure system S and the container C causes the seal 8 to further decompress until the seal 8 no longer contacts the sealing surface 19, as shown in FIG. 8. Consequently, a gap begins to form between the lid portion 6 and the container wall W and the pressure within the container C is released. Any spray caused by the pressure released may be retained by the yoke 4. Also in this position, the link stop 7 of the link 9 engages the stop 5 of the yoke 4 to arrest the movement of the link 9 relative to the yoke 4.

Figure 9:
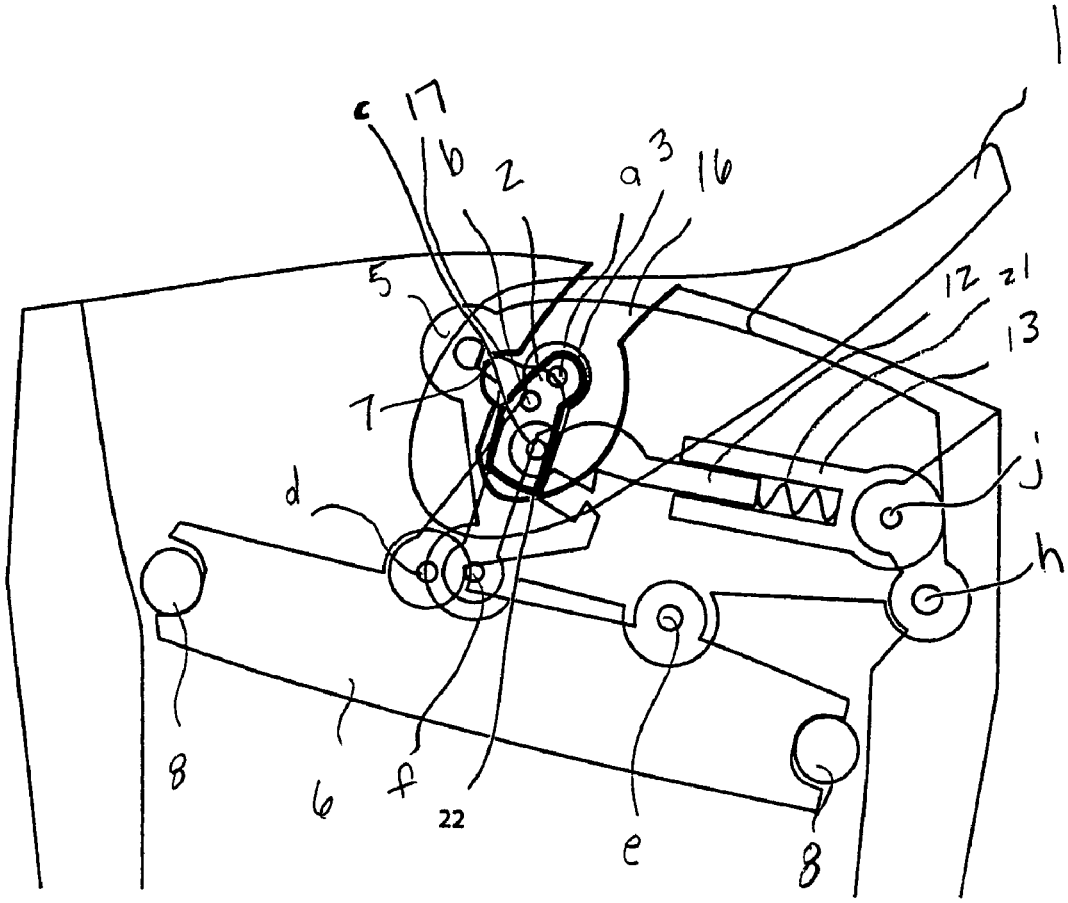
FIG. 9 shows the container and adjustable closure of FIGS. 6, 7, and 8 in an open position.
Figure 10:
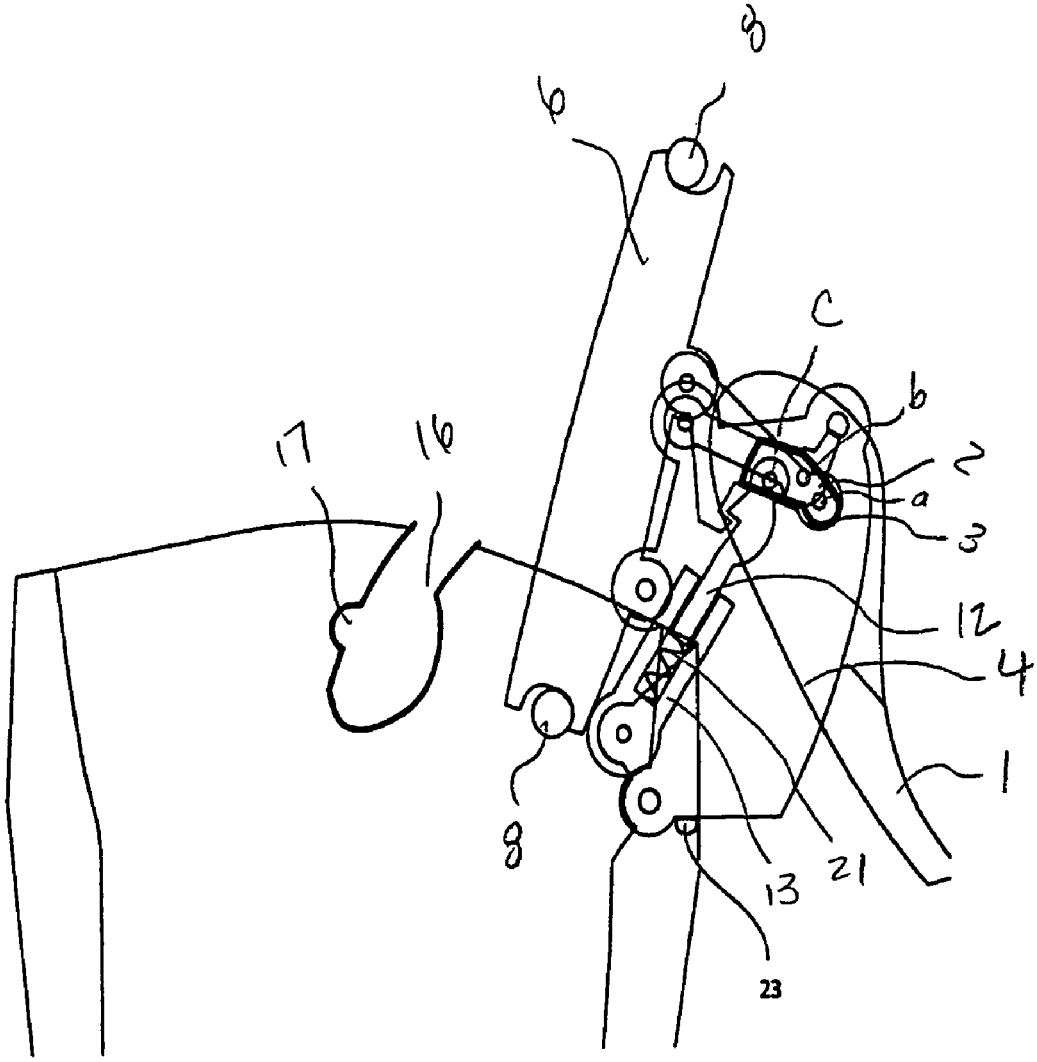
FIG. 10 shows the container and adjustable closure of FIGS. 6, 7, 8, and 9 in a fully open position.
Figure 11:
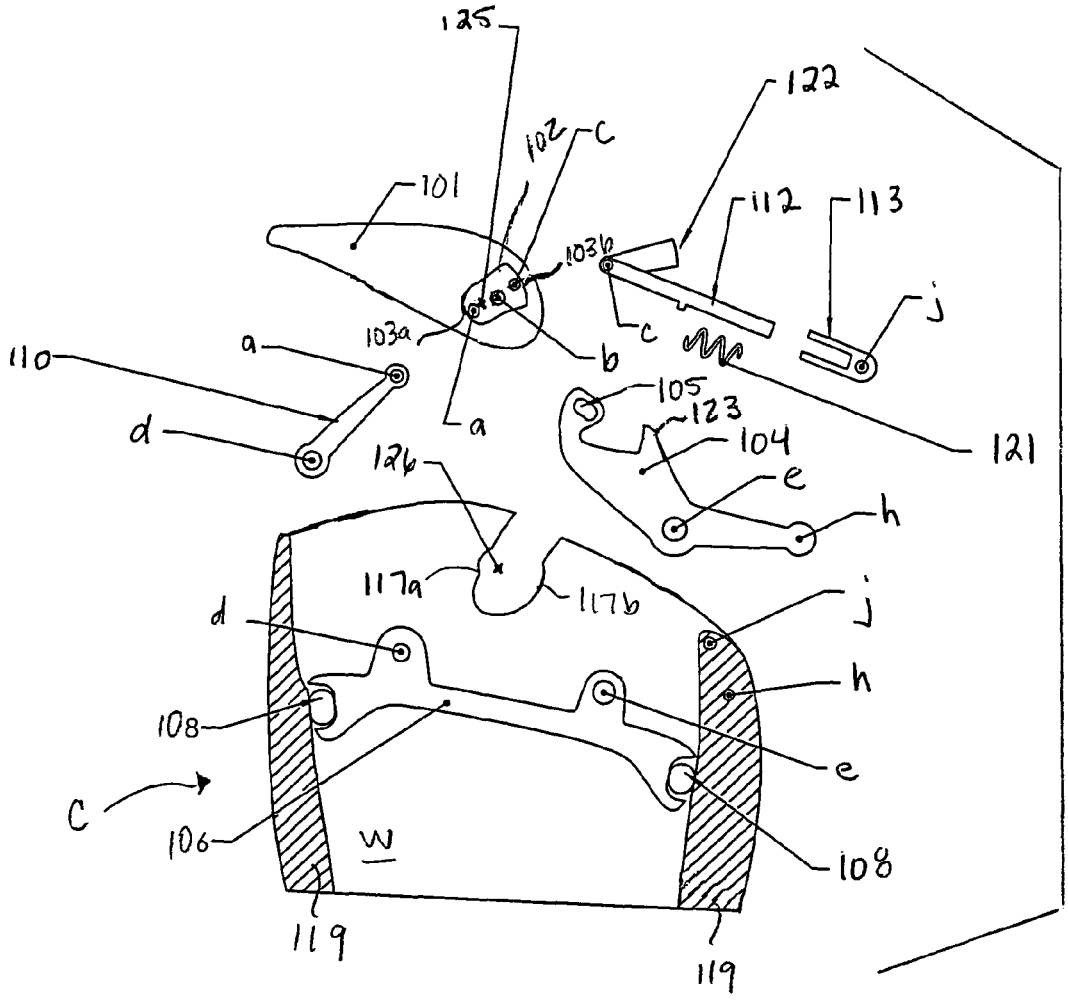
FIG. 11 is an exploded partial side view of a container and components of the adjustable closure of a second embodiment of the present invention in a disassembled position.

Once the seal of the opening O is released, the closure system S may be moved to an open position to allow the beverage B to flow out of the container C. To open the closure S, the lever 1 is further rotated in a clockwise direction until the lever 1 reaches a position adjacent the point j, as shown in FIG. 9. Since the engagement of the link 7 and the stop 5 prohibit any further movement of the link 9, the lever 1 rotates about the point b where the lever 1 is connected to the link 9, as opposed to about the arcuate portions 3 and 17. However, the locking means 2 continues to rotate about the arcuate portions 3 and 17. As the lever 1 rotates about the point b, the arcuate portion 3 of the locking means 2 is cleared from the arcuate portion 17 of the pocket 16 of the container C. Once the locking means 2 is free from the pocket 16, the seal 8 is completely released from the sealing surface 19, and gaps are formed between the lid portion 6 and the container wall W. As a result, the beverage B can flow past the lid portion and out of the container C via the opening O and replacement air can flow into the container C.

In addition to allowing the beverage B to flow from the container C, the closure system S is moveable to a fully open position to allow total access to the interior of the container C. In the fully open position shown in FIG. 10, the catch 11 of the leg 10 engages a latch 15 on the springfront 12 to prevent the lever 1 from rotating relative to the yoke 4. As a result of the kinematic linkages between the components, the leg 10 and the yoke 4 rotate together about the point h where the yoke 4 is pivotally mounted to the container C. The leg 10 and the yoke 4 are free to rotate about the point h until they are held in place by the stop 23 on the container C. In addition, the spring force of the spring 21 retains the closure system S in the fully open position.

Figure 12:
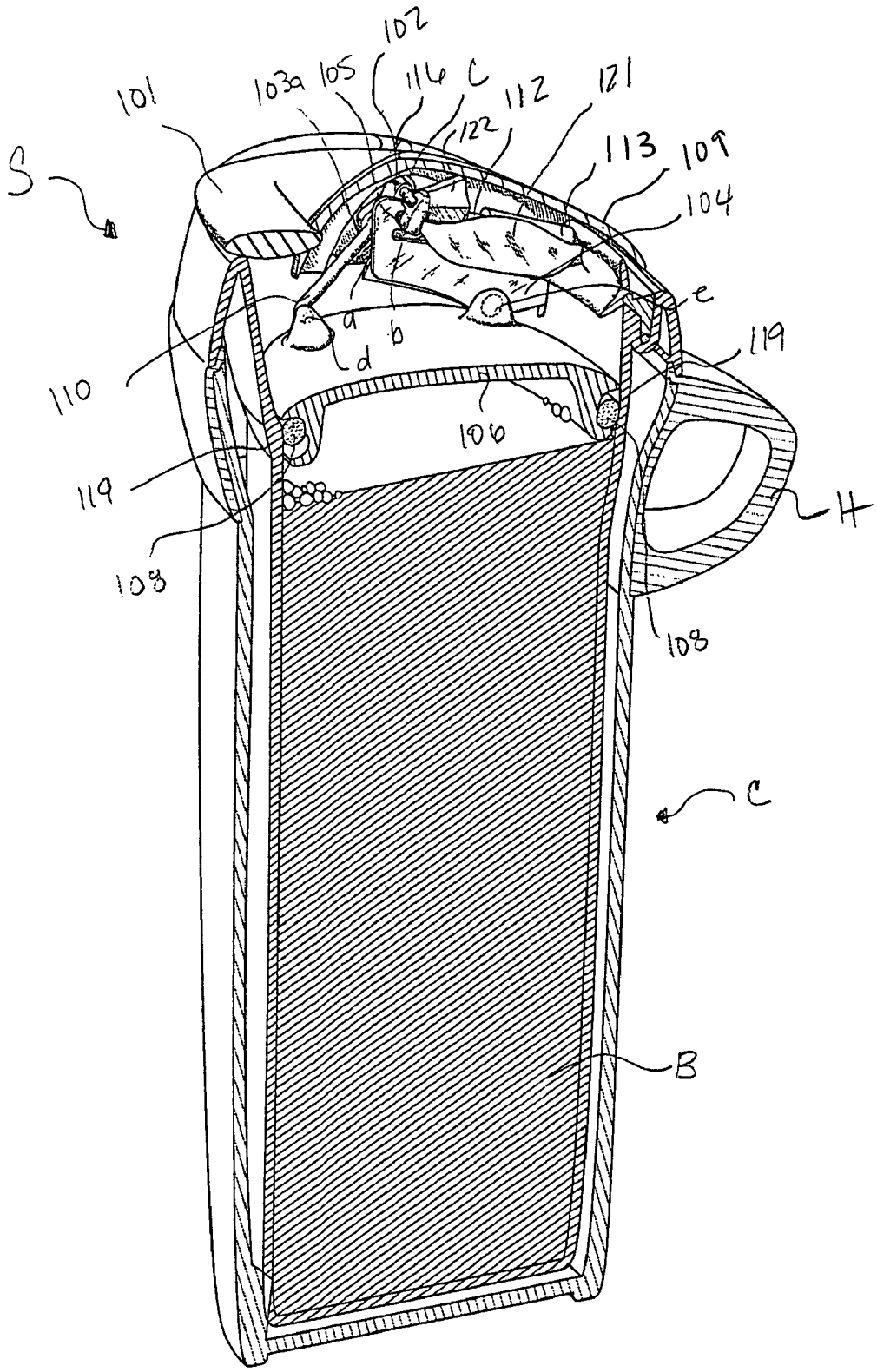
FIG. 12 is a cross-section of a first side perspective view of a filled container and the adjustable closure of the second embodiment, wherein the seal is in a closed, sealed position.
Figure 13:
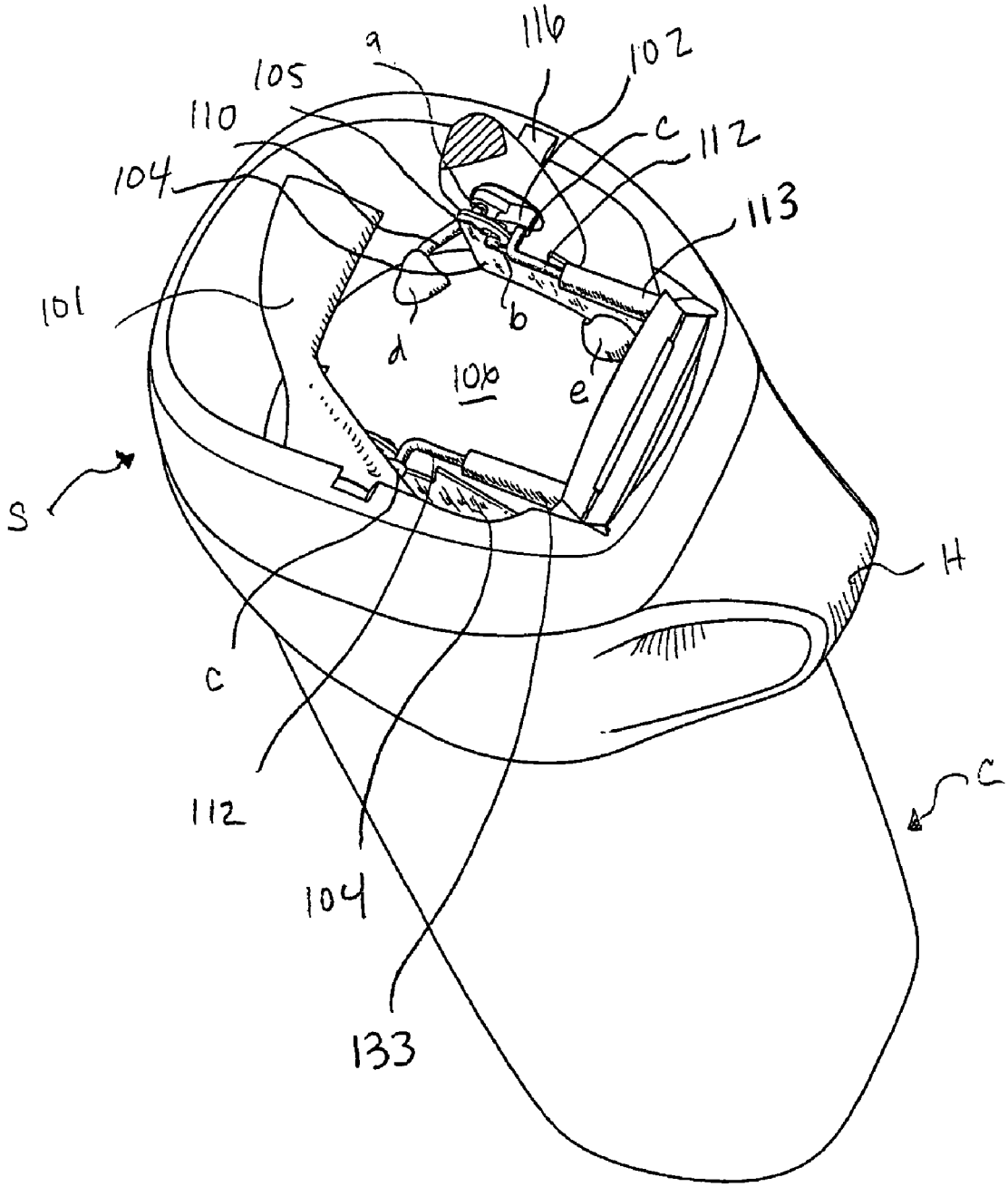
FIG. 13 is a top perspective view of the container and the adjustable closure of the second embodiment, wherein springs are removed.
Figure 14:
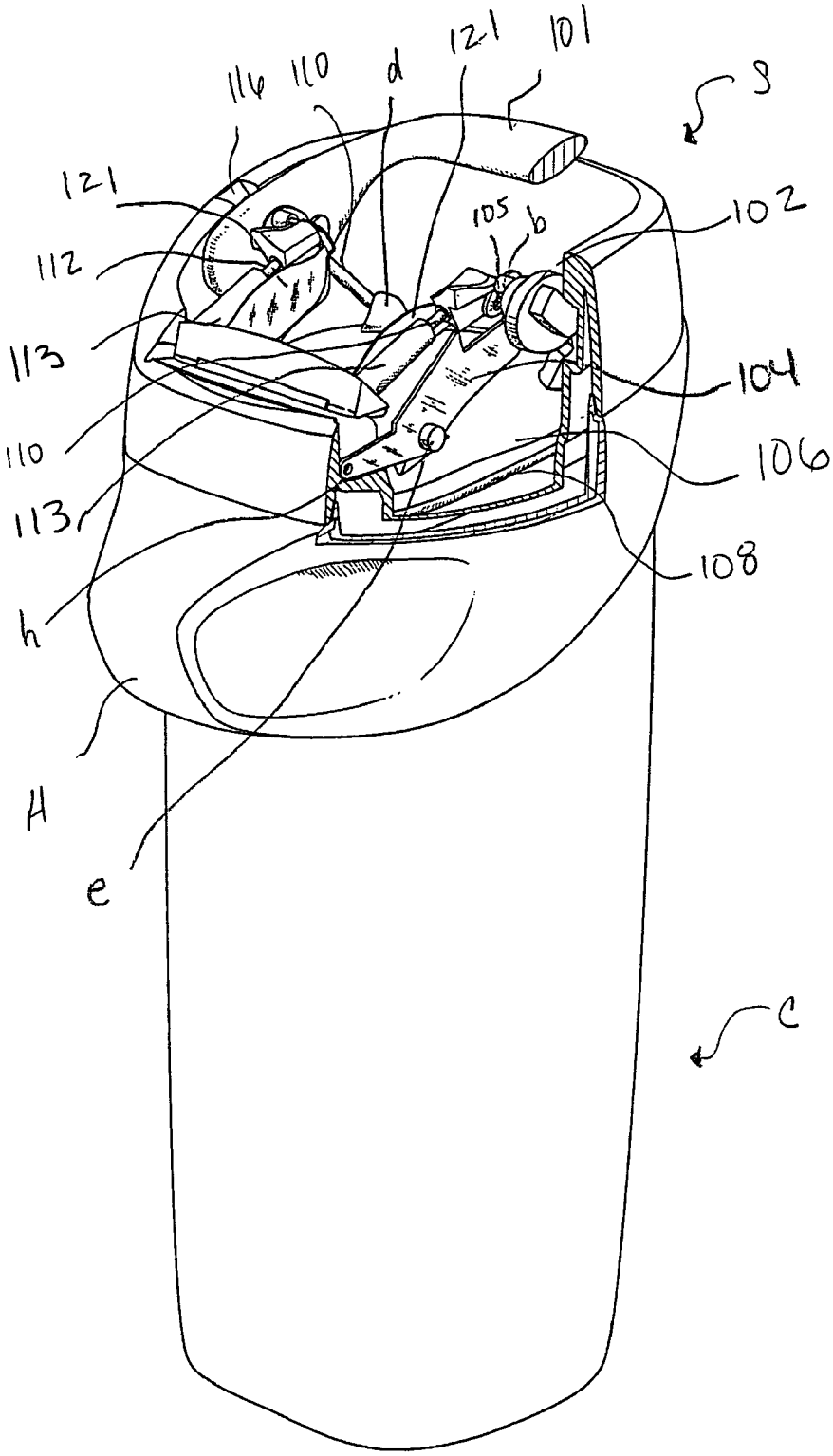
FIG. 14 is second side perspective view of the container and the adjustable closure of the second embodiment, wherein a portion of the closure is cut away.

A second and preferred embodiment of the adjustable closure system S is shown in FIGS. 11-17. While FIGS. 12 and 15-17 only show side views of the closure S so that only half of the kinematic linkages of the closure system S are visible, the closure. S includes symmetrical linkages on an opposite side, as shown in FIGS. 13-14. The closure S comprises a lever 101 having a locking means 102, and the locking means 102 includes two arcuate portions 103*a* and 103*b*. The radius of the arcuate portion 103*a* is smaller than the radius of the arcuate portions 103*b*. Further, the center of the radii or arcuate portions 103*a* and 103*b* is centermark 125.

The closure S also comprises a yoke 104 having a stop 123 and an arcuate slot 105 with an inner edge located furthest from point h. Alternatively, the slot 105 may be a straight slot. In addition, the closure S includes a lid portion 106 and a seal 108, as well as a cover 109 for protecting the components of the closure system S.

The seal 108 is preferably an elastomeric, circular o-ring placed in a circumferential groove around the periphery of the lid portion 106. As an alternative to a circular cross-section, the o-ring may be tapered in cross-section. In addition, the groove may be circular in cross-section or ovalular in cross-section so as to allow an circular o-ring to move therein, as shown in FIG. 12. As another alternative, the groove may have a V-shaped cross-section.

The closure S also includes a leg 110. Further, the closure system S utilizes a spring system including a springfront 112 and a springrear 113 that are secured to each other in a linear relationship via a spring 121, which urges the springfront 112 and the springrear 113 apart. While the spring 121 is preferably a buckled column composed of a leaf of spring steel loaded endwise, any suitable type of spring or energy storage device may be used. Further, the a stop 122 is secured to the springfront 112 to cover the springfront 112.

The container C includes a pocket 116 with two arcuate portions 117*a* and 117*b*. The radius of the arcuate portion 117*a* is smaller than the radius of the arcuate portions 117*b*. Further, the center of the radii or arcuate portions 117*a* and 117*b* is centermark 126. The container further includes a sealing surface 119. If the closure S is integrally formed with the container C, then the pocket 116 and the sealing surface 119 are part of a container wall W. Alternatively, if the closure system S is removably secured to the container C, then the pocket 116 is formed in a separate portion of the closure system S that is attached to the opening O.

To form a kinematic linkage between the closure system S and the container C, the lever 101 is pivotally connected to the leg 110, the slot 105 of the yoke 104, and the springfront 112 at points a, b, and c, respectively, so that the connection of the lever 101 and the leg 110 at the point a is not necessarily concentric with the arcuate portion 103*a* of the locking means 102 of the lever 101. The leg 110 is also pivotally connected to the lid portion 106 at a point d so that the leg 110 links the lever 101 with the lid portion 106. The lid portion 106 is also pivotally secured to the yoke 104 at a point e.

The yoke 104 is also pivotally secured to the container C at a point h, and the springrear 113 is likewise pivotally mounted to the container C at a point j. If the closure system S is integrally formed with the container C, the points h and j are located on a container wall W. Alternatively, if the closure S is fitted onto the container C, then points h and j are formed in a separate portion of the closure system S that is removably attached to the opening O.

In light of the linkages between the lever 101 and the yoke 104 via the slot 105 at the point b and the yoke 104 and the container C at a pivot point h, the arcuate portion 103*a* of the locking means 102 of the lever 101 engages the arcuate portion 117*a* of the pocket 116 of the container C so that the arcuate portions 103*a* and 117*a* are concentric with each other and the centermarks 125 and 126 align. As a result, the locking means 102 cannot move within the pocket 116 other than by rotation of the lever 101 relative to the arcuate portions 103*a* and 117*a*. In an alternative embodiment, the pocket 116 and the arcuate surfaces 117*a* and 117*b* are formed on the lever 101, and the locking means 102 and the arcuate surfaces 103*a* and 103*b* are formed on the container C.

Like the first embodiment, the pivoting connections of kinematic linkages of the components of the second embodiment of the closure system S and the container C may involve pins received in round aperatures. However, oblong slots may also be used to pivotally link the components so as to allow for translating movements, as well as pivoting movements. Further, the pins may not be sized to exactly fit the corresponding aperatures so as to provide some clearance between the pins and the aperatures, which also allows some translating movements between the components.

In light of the kinematic linkage between the closure S and the container C, the closure S is moveable among different positions to provide various degrees of access to and from the container C via the opening O. In other words, the closure system S can effectively seal the opening O of the container C, as well as provide convenient access to the beverage B within the container C and to the interior of the container C. Further, when the closure S is in the sealed position, the closure S is able to withstand any outward force caused by pressure generated by the beverage B within the container C.

Figure 15:
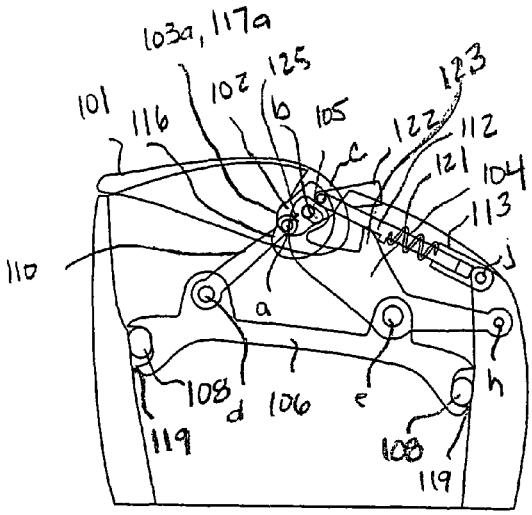
FIG. 15 is a sectioned side view of the container and the adjustable closure of the second embodiment without the spring, wherein the closure is in a closed, sealed position.
Figure 16:
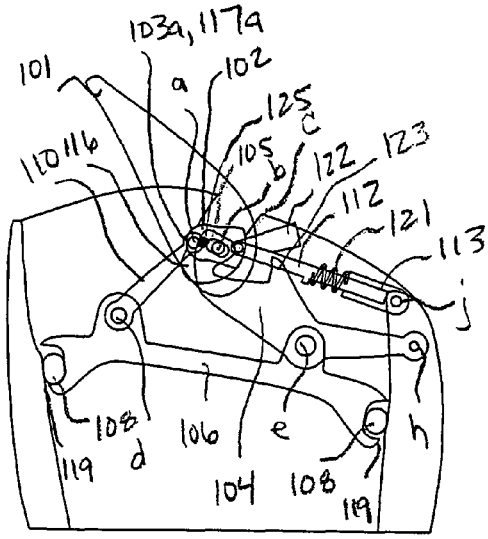
FIG. 16 shows the container and adjustable closure of FIG. 15 in an intermediate position where the closure remains sealed.

To completely seal the opening O of the container C and prevent a beverage B from flowing out of the container C, the spring 121 forces the springfront 112 away from the springrear 113, which is connected to the container C at the point j. Due to the pivoting connection of the springfront 112 and the lever 101 at the point c, the spring force of the spring 121 likewise urges the lever 101 in a counterclockwise direction about the arcuate portions 103*a* and 117*a* of the lever 101 and the pocket 116 of the container C, respectively. Consequently, when the closure S is in the sealed position, the lever 101 is positioned furthest away from the point j where the springrear 113 is connected to the container C, as shown in FIG. 15.

When the lever 101 is positioned furthest away from the point j, the connection of the lever 101 to the lid portion 106 via the leg 110 causes the seal 108 to slide or roll against the sealing surface 119 until the seal 108 is compressed against the sealing surface 119. As a result of the compression of the seal 108 against the sealing surface 119, any gap between the lid portion 106 and the container wall W is closed, and the opening O of the container C is completely sealed.

Figure 17:
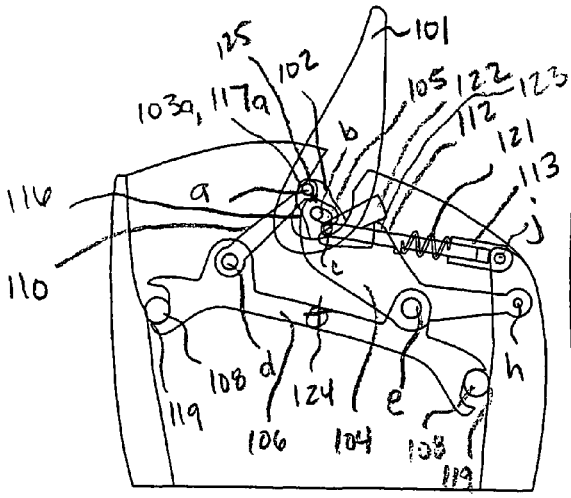
FIG. 17 shows the container and adjustable closure of FIGS. 15 and 16 in an incipient break position.

To release the seal of the opening O, the lever 101 is rotated in a clockwise direction toward the point j. As the lever 101 moves from the position shown in FIG. 15 to the position shown in FIG. 16, the point b moves away from an inner edge of the slot 105 of the yoke 104. As the lever 101 is further rotated in the clockwise direction, the kinematic linkage of the lever 101 and the lid portion 106 via the leg 110 causes a part of the lid portion 106 located at the point d where the leg 110 is connected to the lid portion 106 to begin to move away from the interior of the container C. Simultaneously, the linkage of the lever 101 and the yoke 104 via the slot 105 at the point b causes a part of the lid portion 106 located at the point e where the yoke 104 is connected to the lid portion 106 to start to move toward the interior of the container C, as shown in FIG. 17. As a result, the lid portion 106 rotates about a center of pressure 124 to decompress the seal 108, as well as maintain a constant volume within the container C. In addition, the point b returns to the inner edge of the slot 105, as also shown in FIG. 17.

Figure 18:
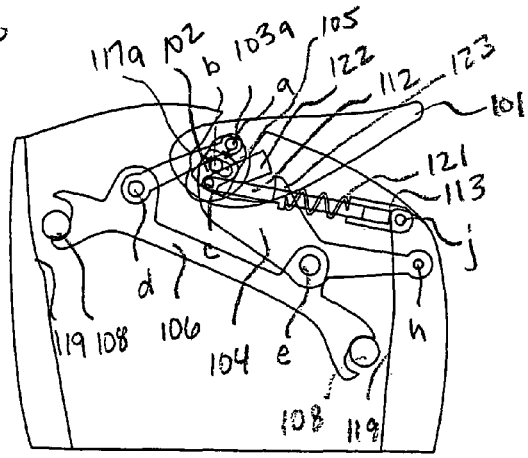
FIG. 18 shows the container and the adjustable closure of FIGS. 15, 16, and 17 in an open, unsealed position.

As the lever 101 is rotated further in a clockwise direction, the kinematic linkage of the components of the closure system S and the container C causes the seal 108 to further decompress until the seal 108 no longer contacts the sealing surface 119, as shown in FIG. 18. Consequently, a gap begins to form between the lid portion 106 and the container wall W and the pressure within the container C is released. Any spray caused by the pressure released is retained by the cover 109.

Figure 19:
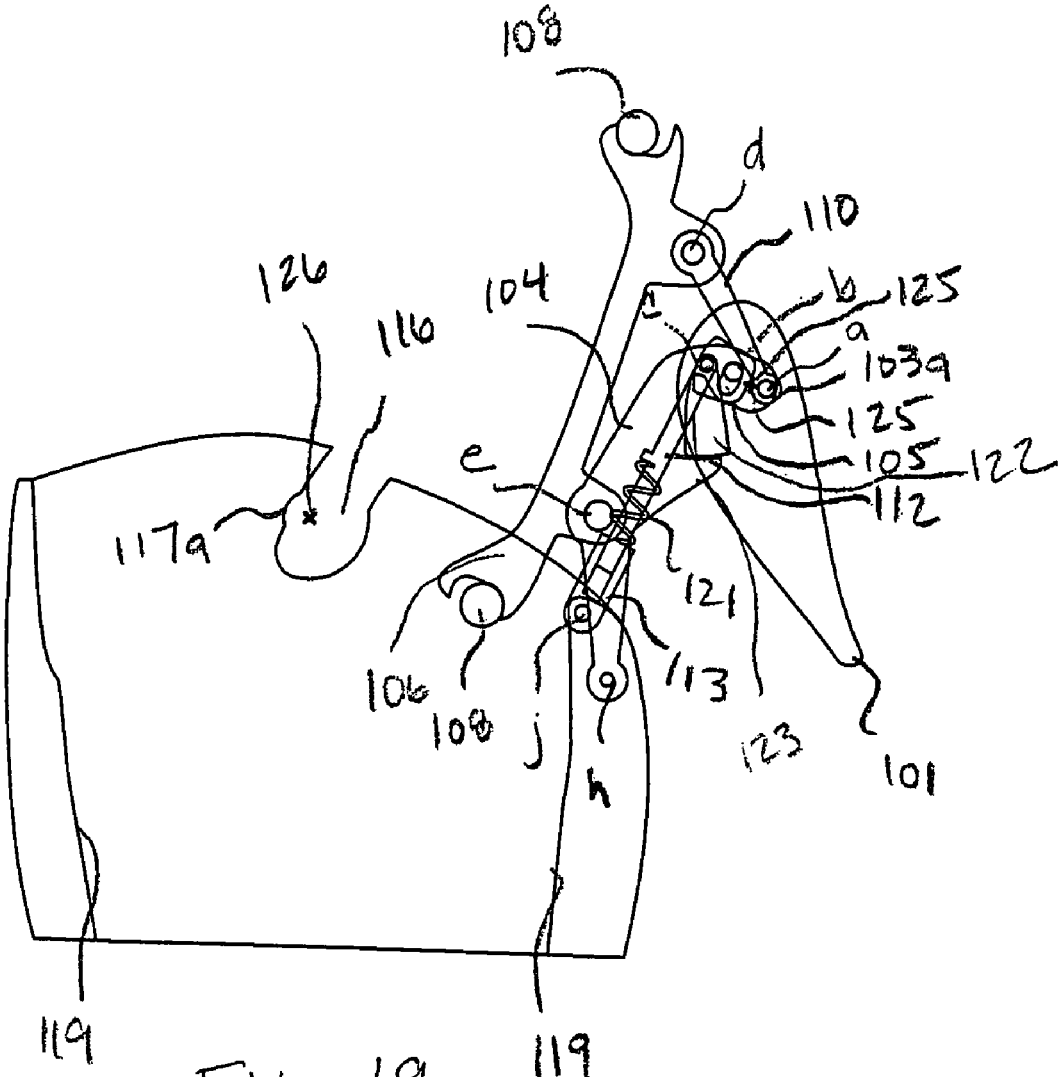
FIG. 19 shows the container and the adjustable closure of FIGS. 15, 16, 17, and 18 in a fully open position.
Figure 20:
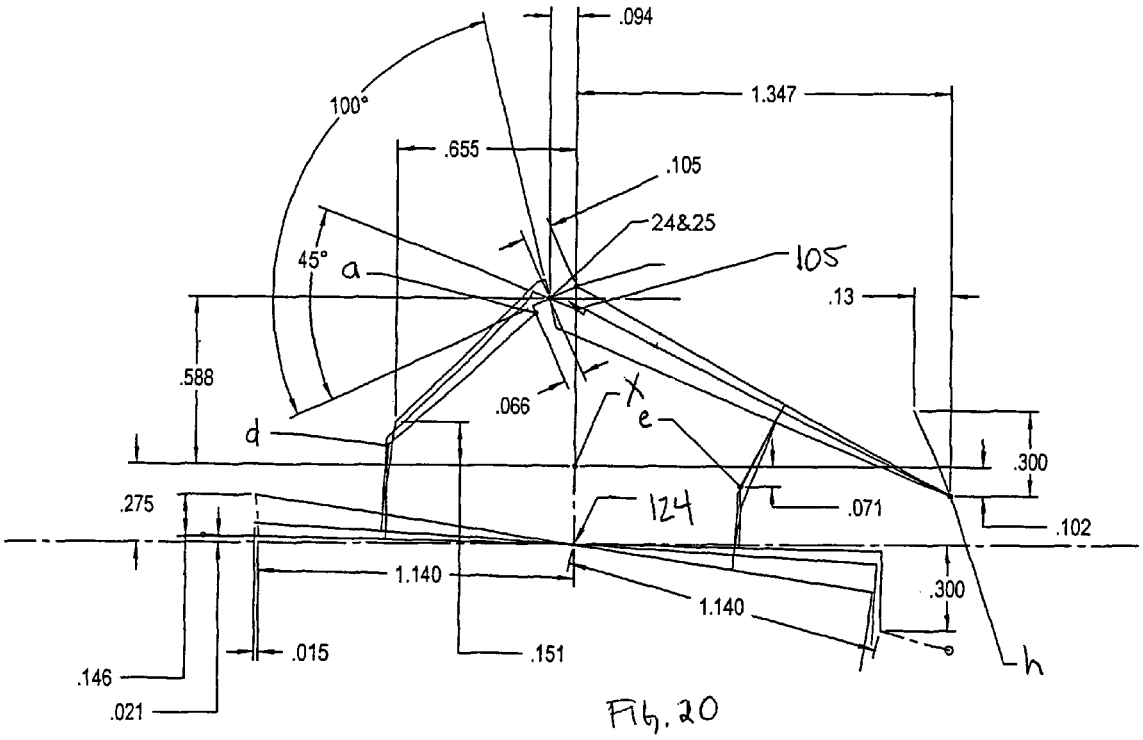
FIG. 20 is an illustrative view of a working example of the adjustable closure including measurements.

Once the seal of the opening O is released, the closure system S may be moved to an open position to allow the beverage B to flow out of the container C. To open the closure S, the lever 101 is further rotated in a clockwise direction until the lever 101 reaches a position adjacent the point j, as shown in FIG. 19. The slot 105 of the yoke 104 prohibits any further movement of yoke 104, and the lever 101 rotates about the point b where the lever 101 is connected to the slot 105 of the yoke 104, as opposed to about the arcuate portions 103*a* and 117*a*. However, the locking means 102 continues to rotate about the arcuate portions 103*a* and 117*a*. As the lever 101 rotates about the point b, the arcuate portion 103*a* of the locking means 2 is cleared from the arcuate portion 117*a* of the pocket 116 of the container C. Once the locking means 102 is free from the pocket 116, the seal 108 is completely released from the sealing surface 119, and gaps are formed between the lid portion 6 and the container wall W. As a result, the beverage B can flow past the lid portion and out of the container C via the opening O, as shown in FIG. 18.

In addition to allowing the beverage B to flow from the container C, the closure system S is moveable to a fully open position to allow total access to the interior of the container C. In the fully open position shown in FIG. 19, the stop 122 contacts the stop 123 of the yoke 104 to prevent the lever 101 from inadvertent actuation. In addition, the spring force of the spring 121 retains the closure system S in the fully open position.

In light of the numerous components of the closure S and the container C and the pivoting connections therebetween, there are a number of possible dimensions and orientation for these components which would effectively seal the opening O of the container C. An example of one such working model of the preferred embodiment of the sealing system S is depicted in FIG. 18. In FIG. 18, the measurements are relative to an origin X.

The foregoing description of the present invention has been presented to illustrate the principles of the invention and not to limit the invention to the particular embodiments illustrated. It is intended that the scope of the invention be defined by all of the embodiments encompassed within the following claims and their equivalents.

I claim:

1. A closure system for a container comprising:

a lid portion;

a lever;

a linkage assembly connecting said lid portion to said lever to provide various degrees of access to an interior of the container, the various degrees of access including a sealed position, an unsealed position which allows some access to the interior of the container, and a fully open position which allows substantially complete access to the interior of the container, said linkage assembly including a leg connecting said lever to said lid portion and a yoke connecting said lever to said lid portion so that as said lever rotates, said lid portion rotates about a center of pressure as the said lever is moved to seal and unseal the container; and a seal substantially surrounding said lid portion to engage a sealing surface of the container when the closure system is in the sealed position.

2. The closure system of claim 1, wherein said lever includes a locking means having an arcuate surface and wherein the container includes a pocket for receiving said locking means therein, said pocket having a first arcuate surface and a second arcuate surface, said first arcuate surface being substantially concentric with said first arcuate surface of said pocket when said locking means are received in said pocket.

3. The closure system of claim 2, wherein said yoke includes a slot for receiving said locking means of said lever so that said locking means moves within said slot.

4. The closure system of claim 3, wherein said lever rotates relative to said first arcuate surface of said pocket to seal and unseal the container, and wherein said lever rotates relative to said slot of said yoke so that said locking means may be removed from said pocket to provide substantially complete access to the interior of the container.

5. The closure system of claim 4, further comprising a spring system connected to the container and to said locking means.

6. The closure system of claim 1, wherein said lever includes a locking means having an arcuate surface, and the closure system further comprising a body portion and an attaching means for attaching the closure system to a container, said body portion including a pocket for receiving said locking means therein, said pocket having a first arcuate surface and a second arcuate surface, said first arcuate surface being substantially concentric with said first arcuate surface of said pocket when said locking means are received in said pocket.

7. The closure system of claim 6, wherein said yoke includes a slot for receiving said locking means of said lever so that said locking means moves within said slot.

8. The closure system of claim 7, wherein said lever rotates relative to said first arcuate surface of said pocket to seal and unseal the container, and wherein said lever rotates relative to said slot of said yoke so that said locking means may be removed from said pocket to provide substantially complete access to the interior of the container.

9. A container comprising: a closure system pivotally connected to the container and having a lid portion, a lever, a linkage assembly connecting said lid portion to said lever to provide various degrees of access to an interior of the container, the various degrees of access to the interior of the container including a sealed position, an unsealed position which allows some access to the interior of the container, and a fully open position which allows substantially complete access to the interior of the container, said linkage assembly including a leg connecting said lever to said lid portion and a yoke connecting said lever to said lid portion so that as said lever rotates, said lid portion rotates about a center of pressure as the lever is moved to seal and unseal the container, and a seal substantially surrounding said lid portion to engage a sealing surface of the container when said closure system is in the sealed position.

10. The container of claim 9, wherein said lever rotates relative to said first arcuate surface of said pocket to seal and unseal the container, and wherein said lever rotates relative to said slot of said yoke so that said locking means may be removed from said pocket to provide substantially complete access to the interior of the container.

11. The closure system of claim 10, wherein said yoke includes a slot for receiving said locking means of said lever so that said locking means moves within said slot.

12. The closure system of claim 11, wherein said lever rotates relative to said first arcuate surface of said pocket to seal and unseal the container, and wherein said lever rotates relative to said slot of said yoke so that said locking means may be removed from said pocket to provide substantially complete access to the interior of the container.

13. The closures system of claim 12, further comprising a spring system connected to the container and to said locking means.

* * * * *